US009587530B2

(12) United States Patent
Manther

(10) Patent No.: US 9,587,530 B2
(45) **Date of Patent: *Mar. 7, 2017**

(54) SWITCHABLE FINGER FOLLOWER WITH NORMALLY UNLOCKED COUPLING ELEMENT

(71) Applicant: Schaeffler Technologies AG & Co. KG, Herzogenaurach (DE)

(72) Inventor: Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 58 days.

This patent is subject to a terminal disclaimer.

(21) Appl. No.: 14/666,374

(22) Filed: Mar. 24, 2015

(65) Prior Publication Data

US 2015/0275712 A1 Oct. 1, 2015

Related U.S. Application Data

(60) Provisional application No. 61/972,667, filed on Mar. 31, 2014.

(51) Int. Cl.
*F01L 1/18* (2006.01)
*F01L 13/00* (2006.01)

(52) U.S. Cl.
CPC ..... *F01L 13/0036* (2013.01); *F01L 1/185* (2013.01); *F01L 13/0005* (2013.01); *F01L 1/18* (2013.01); *F01L 2001/186* (2013.01)

(58) Field of Classification Search
CPC ..... F01L 1/18; F01L 1/185; F01L 13/0005; F01L 13/0036; F01L 2001/186
USPC ..... 123/90.39, 90.44, 90.45
See application file for complete search history.

(56) References Cited

U.S. PATENT DOCUMENTS

| | | | |
|---|---|---|---|
| 7,174,869 B2 | 2/2007 | Proschko et al. | |
| 7,677,213 B2 * | 3/2010 | Deierlein | F01L 1/185 123/90.16 |
| 7,909,007 B2 | 3/2011 | Manther et al. | |
| 8,251,032 B2 | 8/2012 | Manther et al. | |

* cited by examiner

*Primary Examiner* — Ching Chang
(74) *Attorney, Agent, or Firm* — Volpe and Koenig, P.C.

(57) ABSTRACT

A switchable finger follower having two lift modes for a valve train of an internal combustion engine. The follower includes a primary lever with a valve stem support at the first end and a support recess at the second end. A secondary lever is pivotably mounted to the primary lever at the first end, including a coupling surface. A coupling device is located on the primary lever having a coupling pin moveable between a first locking position, in which the secondary lever is locked to the inner lever, and an unlocked position, in which the secondary lever is pivotable relative to the primary lever. The coupling pin includes a ramp surface that engages the coupling surface, and a locking arrangement locks the coupling pin in the first locking position.

19 Claims, 4 Drawing Sheets

SWITCHABLE FINGER FOLLOWER WITH NORMALLY UNLOCKED COUPLING ELEMENT

INCORPORATION BY REFERENCE

The following documents are incorporated herein by reference as if fully set forth: U.S. Provisional Application No. 61/972,667, filed Mar. 31, 2014.

FIELD OF INVENTION

The invention relates to roller finger followers that are used in overhead cam-type internal combustion engines and, more particularly, to switchable roller finger followers that have a high lift and a low or no lift mode.

BACKGROUND

Switchable roller finger followers are known. See, for example, U.S. Pat. No. 7,174,869. Such finger followers have an outer lever as a secondary lever pivotably mounted outside an inner lever acting as a primary lever and a roller rotatably mounted on a transverse axle in a slot in the inner lever. The top surface of the outer lever acts as a contact surface for a high lift cam and the top surface of the roller acts as a contact surface for a low lift cam. A coupling element is mounted at one end of the finger follower and oil from an oil source is used to activate the coupling element. When the coupling element is activated, it locks the outer lever to the inner or primary lever and requires the finger follower to follow the high lift cam and transfer the lift to the valve stem of an associated intake or exhaust valve. When the coupling element is deactivated, the outer or secondary lever is free to pivot relative to the inner or primary lever and, under the aid of a spring, the outer lever pivots freely in conjunction with the high lift cam while the motion of the low lift cam is transferred by the inner lever to the valve stem. This movement by the outer lever is conventionally referred to as the lost motion stroke.

Conventionally, the outer lever is a unitary structure such that the coupling element need only operate on one part of the outer lever. Typically, the coupling device operates on a yoke portion of the outer layer, the yoke portion being transverse to the longitudinal axis of the finger follower. Conventionally, the roller axle is staked to the inner lever to maintain its lateral position relative to the inner lever. U.S. Pat. No. 7,909,007 discloses a roller finger follower of this type. This provides a lost motion spring to maintain contact between the cam follower and the cam.

U.S. Pat. No. 8,251,032 discloses a prior switchable roller finger follower of the inventor in which two locking pins of the coupling device are extended outwardly to a locked position under each of outer arms via oil pressure, and are uncoupled via separate return springs when insufficient oil pressure is present. U.S. Pat. No. 8,251,032 is incorporated herein by reference as if fully set forth.

Arrangements are also known for a switchable finger follower in which the outer arm forms the primary lever, and the inner arm with the roller forms the secondary lever. These a locking device on the outer lever is normally engaged with the inner lever during normal valve operation. The valve is deactivated by disengaging the locking device from the inner lever so that the inner lever travels with a lost motion stroke against a return spring force when contacted by the cam, allowing the associated gas exchange valve to remain inactive.

It would be desirable to provide a finger follower of the type noted above with simpler manufacturing and reduced costs, as well as the possibility for additional valve lift positions.

SUMMARY

Briefly stated, a switchable roller finger follower having at least two lift modes for a valve train of an internal combustion engine is provided. The lift modes can be a hi-lift-lo-lift or a lift-no-lift. The switchable roller finger follower includes a primary lever, which can be an inner lever or an outer lever, having first and second ends, with a valve stem support located at the first end and a lash adjuster support recess located at the second end. In the case of the primary lever being the inner lever, a slot is provided in which a roller is mounted by a transverse axle. A secondary lever, which can be an outer lever formed by two outer arms that extend along longitudinal sides of the inner lever, or an inner lever mounted within an opening in an outer lever, is mounted for pivoting movement at the first end of the primary lever by a pivot axle. The secondary lever may be in the form of the outer lever having outer arms which each include a high lift cam contact surface located adjacent to the roller, or an inner lever with a cam contact surface, preferably also in the form of a roller. A coupling surface is also located on the secondary lever and faces the second end. A coupling device is located on the second end of the primary lever and includes a coupling pin arranged to move in a longitudinal direction between at least a first locking position, in which the secondary lever is locked in a first lift position and are lockable to the inner lever at least in an activation direction of a valve, and an unlocked position, in which the secondary lever is pivotable relative to the primary lever. The coupling pin includes a ramp surface that contacts a respective coupling surface of the secondary lever. A locking arrangement is provided for locking the coupling pin in the first locking position.

In another aspect, for the secondary lever being the outer lever, the coupling pin has transversely extending arms that each include one of the ramp surfaces, and the outer arms have complementary ramps to the ramp surfaces. Preferably, the coupling pin is biased toward the outer arms by a spring, and the ramps on the outer arms and the ramp surfaces of the coupling pin remain in constant contact. Through this arrangement with the ramp surfaces always in contact with each other, there is no need to provide for locking lash, and the ramp surfaces eliminate the need for any lash in the arrangement.

In another aspect, separate lost motion springs can be located between the inner lever and the outer arms.

In another aspect, for the secondary lever being the inner lever, the coupling surface of the inner lever includes a complementary ramp to the ramp surface on the coupling pin. The coupling pin is biased toward the inner lever by a spring, and the ramp on the inner lever and the ramp surface of the coupling pin remain in constant contact. Through this arrangement with the ramp surfaces always in contact with each other, there is no need to provide for locking lash, and the ramp surfaces eliminate the need for any lash in the arrangement In another aspect, the coupling pin is biased toward the first locking position by a spring, and a spring force of the spring is less than the force generated by the valve spring acted on by the finger follower so that the spring acts as a lost motion spring for the secondary lever in the unlocked state of the finger follower, and the coupling pin is adapted to reciprocate for each rotation of a cam between the first locking position and the unlocked position.

Preferably, the coupling device comprises a coupling housing located on the primary lever with a coupling pin bore in which the coupling pin is located. Preferably, the locking arrangement includes a hydraulic fluid passage located in the primary lever that extends to a pressure space in the coupling pin bore defined behind the coupling pin, and pressurized hydraulic fluid provided to the pressure space locks the coupling pin in the first locking position.

In another aspect of the invention, a valve train is provided which includes a switchable roller finger follower according to the invention including one or more of the features discussed above. A pressure regulator is connected to the hydraulic fluid passage that extends to the pressure space and controls a flow of hydraulic fluid to the pressure space for locking the coupling pin in the first locking position.

In another aspect, the pressure regulator is a variable pressure regulator and regulates a pressure of the hydraulic fluid fed to the pressure space so that the coupling pin is lockable in at least a second locking position which provides a different lift than the first locking position. Here, the second locking position is determined based on a combined force provided the spring force of the spring and the pressure force of the hydraulic fluid as regulated by the pressure regulator. Preferably, the pressure regulator is connected to a controller, such as the engine control module, in order to allow the high lift cam contact surfaces of the outer arms to be locked in more than one position or, in the case when the coupling device is unlocked, allows the outer arms to reciprocate up and down with the movement being taken up by the coupling pin and coupling pin spring as well as optionally the additional lost motion springs. This arrangement provides the advantage of being able to set the coupling mechanism in various different positions. Further, since the coupling pin ramp surfaces and the secondary lever are always in contact, locking lash is eliminated. Thus, multiple advantages are provided by the finger follower according to the present invention.

In one embodiment, for the secondary lever being the outer lever, the outer arms are attached in a rotationally fixed manner to the pivot axle so that they pivot together as a unit. In another embodiment, the outer arms are held with a slip fit on the pivot axle and can pivot relative to the swing pivot axle. The outer arms are held axially in position by snap rings, spring clips or staking.

Using one or more of these features results in a switchable finger follower with reduced complexity with additional functionality while also allowing easier manufacturing and assembly, a low weight, and a low mass moment of inertia.

Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
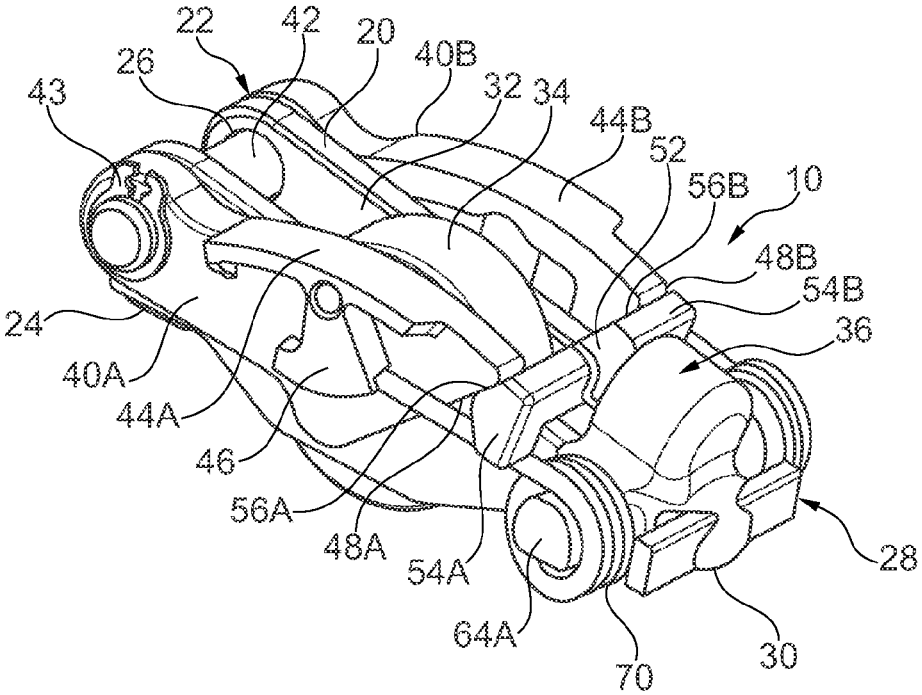
FIG. 1 is a perspective view of a switchable roller finger follower according to a first embodiment of the invention which includes separate lost motion springs.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, a first embodiment of the switchable finger follower 10 according to the present invention is shown. The switchable roller finger follower 10 includes at least two lift modes and is usable in connection with a valve train of an internal combustion engine, such as illustrated schematically in FIG. 5.

The finger follower 10 includes a primary lever, here in the form of an inner lever 20 having a first end 22 and a second end 28. A valve stem support 24 is located at the first end 22 and is adapted to contact a valve stem, such as valve stem 18 in FIG. 5. A pair of aligned bores 26 extend through the inner lever 20 at the first end 22. As shown in detail in FIG. 2, a lash adjuster support recess 30 is located at the second end 28. Preferably, the lash adjuster support recess 30 is hemi-spherical in shape and is adapted to receive the head of a lash adjuster support, such as the lash adjuster support 14 shown in FIG. 5.

Figure 5:
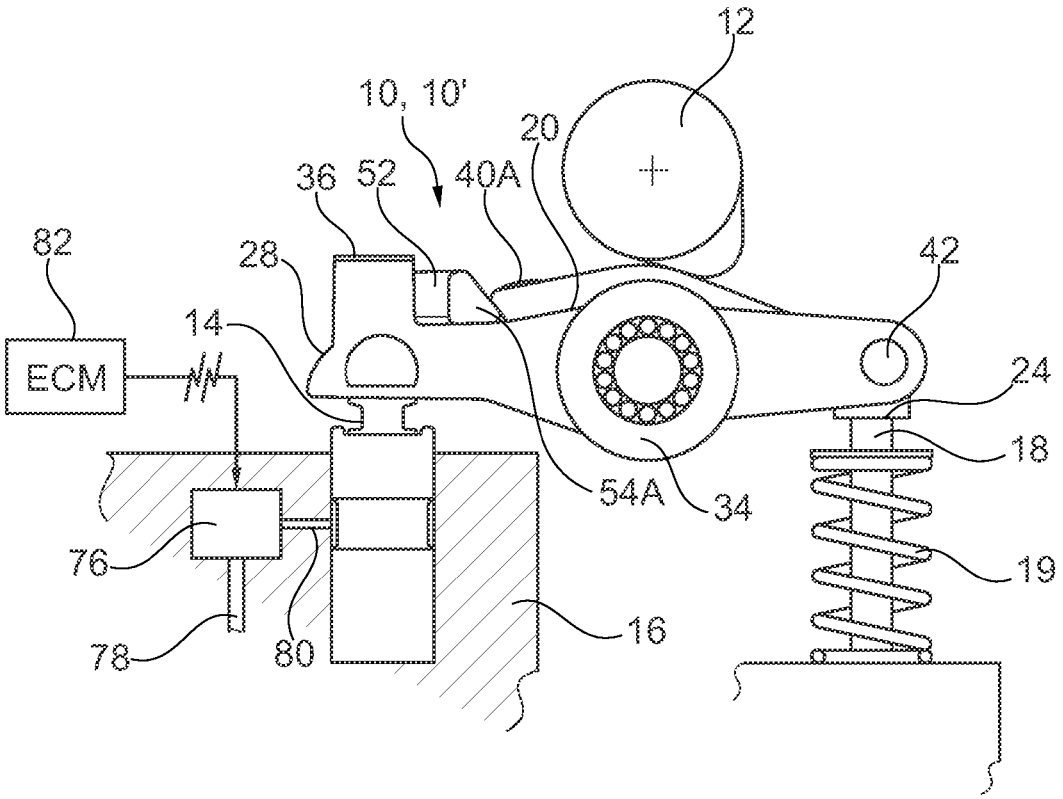
FIG. 5 is a schematic view showing a valve train with the switchable roller finger follower according to the invention.

A slot 32 is preferably located in the inner lever 20. A roller 34 is mounted via an axle 35 in the slot 32 and acts as a cam contact surface for the cam of a camshaft 12, for example as shown in FIG. 5. The roller 34 is preferably supported via needle bearings; although a plain bearing arrangement could be utilized with an inner surface of the roller resting directly on the axle 35.

A secondary lever, here in the form of two outer arms 40 that extend along longitudinal sides of the inner lever 20 are mounted for pivoting movement at the first end 22 of the inner lever 20 by a pivot axle 42 that extends through the aligned bores 26. The outer arms 40A, 40B can be mounted with an interference fit on the pivot axle 42 such that the outer arms 40A, 40B move in unison. Alternatively, the outer arms 40A, 40B can be mounted with a slip fit and held in place via a lock ring 43, as shown in FIG. 1, so that the outer arms 40A, 40B are independently pivotable about the pivot axle 42. Alternatively, the two outer arms 40A, 40B can be formed as a single U-shaped part, with an integral pivot axle. The outer arms 40A, 40B each include a cam contact surface 44A, 44B. This is preferably a high lift cam contact surface and it is located adjacent to the roller 34. As shown in detail in FIG. 2, each of the outer arms 40A, 40B also includes a coupling surface 48A, 48B which face the second end 28.

In the embodiment of the finger follower 10 shown in FIG. 1, preferably spring supports 46 for lost motion springs are located on the outer arms and spring posts 64A, 64B are located at the second end 28 of the inner lever 20. A lost motion spring 70 can then be connected to the spring posts 64A, 64B on the inner lever 20 and engage under the spring supports 46 on the outer arms 40A, 40B in order to bias the outer arms 40A, 40B upwardly and absorb the lost motion of the outer arms 40A, 40B when the coupling device 36 is in an unlocked position, which will be described in further detail below.

Figure 2:
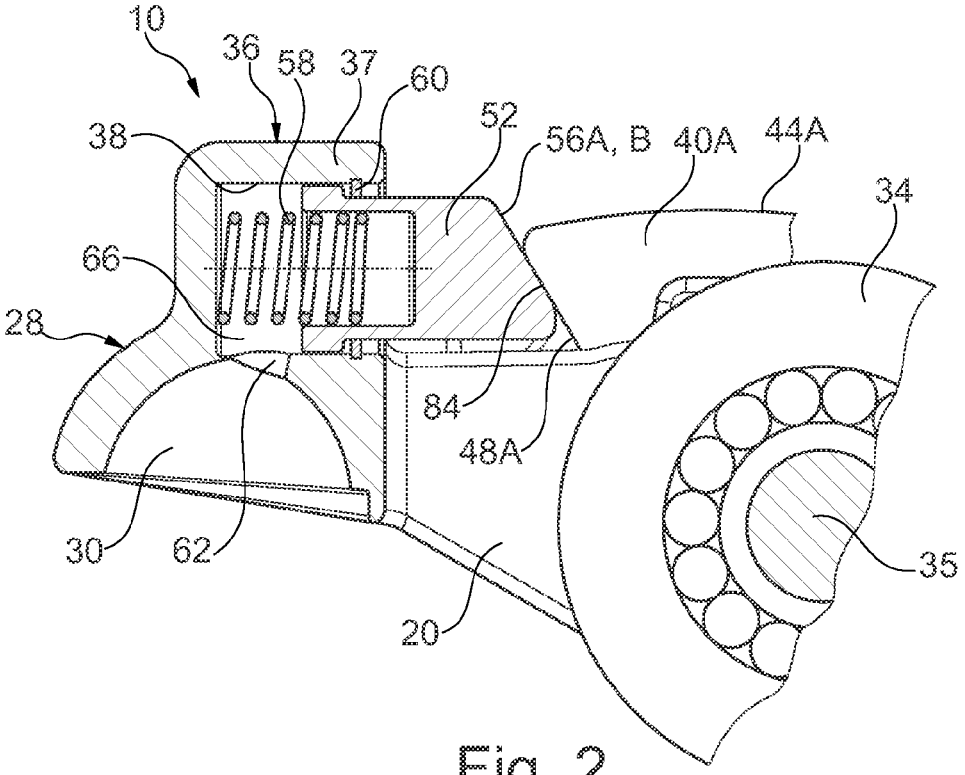
FIG. 2 is a partial cross-sectional view through the switchable roller finger follower shown in FIG. 1, showing the coupling pin in the first, locked position in which the outer arms are locked in a first lift position.

Still with reference to FIGS. 1 and 2, the finger follower 10 includes the coupling device 36 located on the inner lever 20. The coupling device 36 preferably includes a housing 37 having a coupling pin bore 38 located therein, as shown in detail in FIG. 2. A coupling pin 52 is located in the coupling pin bore 38 and is arranged to move in a longitudinal direction between at least a first locking position, in which the outer arms 40A, 40B are in a first lift position and are lockable to the inner lever 20 at least in an activation direction of a valve, and an unlocked position, in which the outer arms 40A, 40B are pivotable relative to the inner lever 20. The coupling pin 52 includes transversely extending arms 54A, 54B that contact the respective coupling surface of each of the outer arms 40A, 40B. Preferably, at least one of the coupling surfaces 48A, 48B of the outer arms 40A, 40B or the contact surfaces on the transversely extending arms 54A, 54B of the coupling pin 52 are coated with a friction or wear reducing coating, indicated at 84 in FIG. 2, such as a diamond-like carbon coating.

Preferably, the coupling surfaces 48A, 48B of the secondary lever, here in the form of the outer arms 40A, 40B comprise ramps, and the transversely extending arms 54A, 54B of the coupling pin 52 include complementary ramp surfaces 56A, 56B to the ramps 48A, 48B. As shown in FIG. 2, the coupling pin 52 is biased toward the outer arms 40A, 40B by a spring 58. Preferably, this allows the ramps 48A, 48B on the outer arms 40A, 40B to remain in constant contact with the ramp surfaces 56A, 56B of the coupling pin arms 54A, 54B. The spring 58 biases the coupling pin 52 toward the first locking position. Preferably, a spring force of the spring 58 is less than a force generated by a valve spring acted on by the finger follower 10 so that the spring 58 acts as a lost motion spring for the outer arms 40A, 40B in the unlocked position, and the coupling pin 52 is adapted to reciprocate for each rotation of a cam between the first locking position and the unlocked position in the unlocked mode. Here, a cam of the camshaft would act on the roller 34 to provide a low lift while the outer arms 40A, 40B would reciprocate up and down against the force of the spring 58 as well as in the first embodiment against the force of the lost motion spring 70 acting on each of the outer arms 40A, 40B.

As shown in FIG. 2, as a locking arrangement of the coupling device 36, a hydraulic fluid passage 62 is located in the inner lever 20 and extends to a pressure space 66 in the coupling pin bore 38 defined behind the coupling pin 52. Pressurized hydraulic fluid provided to the pressure space 66 locks the coupling pin 52 in the first locking position, which corresponds to the position shown in FIG. 2. Here, the coupling ramp surfaces 48A, 48B of the outer arms 40A, 40B are held via the pressurized hydraulic fluid force in combination with the force of the spring 58 in the chamber 66 in the first locking position. The coupling pin 52 is retained in the coupling pin bore 38 via a lock ring 60 locked within the coupling pin bore 38 contacting shoulders located at a base of the coupling pin 52. When the hydraulic fluid pressure is released, the coupling pin 52 is unlocked and allowed to reciprocate in order to absorb the lost motion of the secondary or outer arms 40A with the high lift contact surfaces 44A, 44B. Those skilled in the art will recognize that as an alternative, the coupling pin 52 can be held in the first locking position by a hydraulic pressure releasable catch, so that in the state when pressurized hydraulic fluid is not supplied, the coupling pin 52 is locked, and the application of pressurized hydraulic fluid releases the catch so that the coupling pin 52 is unlocked and allowed to reciprocate in order to absorb the lost motion of the outer arms 40A with the high lift contact surfaces 44A, 44B.

Figure 3:
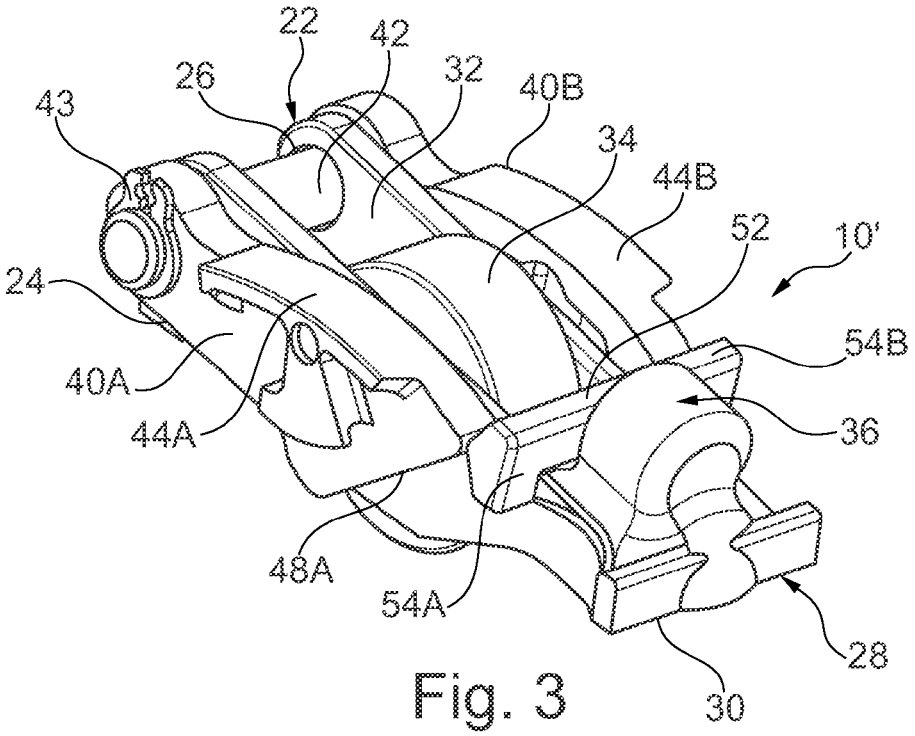
FIG. 3 is a perspective view of a switchable roller finger follower according to another embodiment of the invention in which there are no separate lost motion springs.
Figure 4:
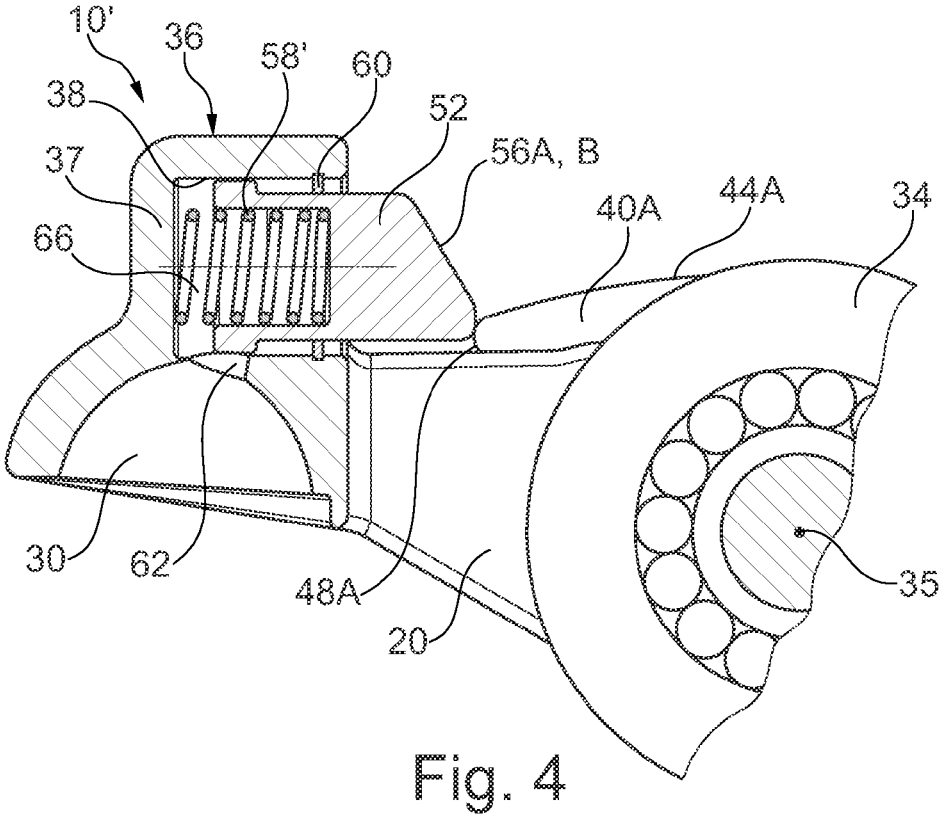
FIG. 4 is a cross-sectional view similar to FIG. 2 showing the coupling pin in the inner-most unlocked position with the full motion of the outer arms being compensated via the lost motion spring.

Referring to FIG. 3, a second embodiment of the switchable roller finger follower 10' is shown. The switchable roller finger follower 10' is identical to the switchable roller finger follower 10 shown in FIG. 1 except that the additional lost motion springs 70 along with the spring posts 64A, 64B have been eliminated and only the spring 58' is used to act as the lost motion spring. This arrangement requires the spring 58' to have a higher spring constant than in the case where separate lost motion springs 70 are also provided. The operation of the switchable roller finger follower 10' is the same as the switchable roller finger follower 10 with the exception that the lost motion of the outer arms 40A, 40B when the finger follower 10' is in the unlocked position is absorbed solely via the spring 58'. It is noted that the finger follower 10' shown in FIGS. 3 and 4 is shown in the lost motion position of the outer arms 40A, 40B in which a cam on the camshaft has pressed the outer arms 40A, 40B downwardly and the lost motion of the outer arms 40A, 40B has been absorbed by pressing the coupling pin 52 inwardly into the coupling pin bore 38. In contrast, in FIGS. 1 and 2 the finger follower 10 is shown with the outer arms 40A, 40B in the first locking position so that if pressurized hydraulic fluid was applied to the pressure space 66, the outer arms 40A, 40B would be locked in the first locking position to provide a high lift to the valve stem 18 via the switchable finger follower 10.

Referring to FIG. 5, a valve train including the switchable finger follower 10, 10' is shown. Here, the finger follower 10, 10' is located beneath a camshaft 12 with the first end 22 contacting a valve stem 18 of a gas exchange valve of an internal combustion engine. The valve spring 19 is shown on the valve stem 18 to hold the valve in a closed position. The second end 28 of the inner lever 20 is supported on the head of a lash adjuster support 14. Pressurized hydraulic fluid from the engine oil gallery 78 is delivered to a pressure regulator 76 which controls a pressure of the hydraulic fluid supplied via the oil passage 80 to the lash adjuster support 14 from which it is fed to the oil passage 62 in the inner lever 20. The pressure regulator 76 can be connected to the engine control module 82 or another controller and, depending upon engine conditions, can provide higher pressure oil to the chamber 66 in order to lock the coupling pin 52 in the first locking position, in which the outer arms 40A, 40B are locked in the first lift position to the inner lever 20. The pressure regulator 76 can also regulate a pressure of the hydraulic fluid fed to the pressure chamber 66 so that the coupling pin is lockable in at least a second locking position in which the pin 52 is not fully extended (as shown in FIG. 2) providing a different lift than the first locking position.

This provides the advantage of a multi-variable lift finger follower not previously known.

Both embodiments of the finger follower 10, 10' provide that the outer arms 40A, 40B as the secondary levers are always in contact with the ramp surfaces 56A, 56B on the coupling pin 52 and accordingly locking lash is eliminated. Further, according to the embodiment shown in FIG. 3 of the finger follower 10' the additional lost motion springs can be eliminated provided for a simpler assembly with reduced cost.

Figure 6:
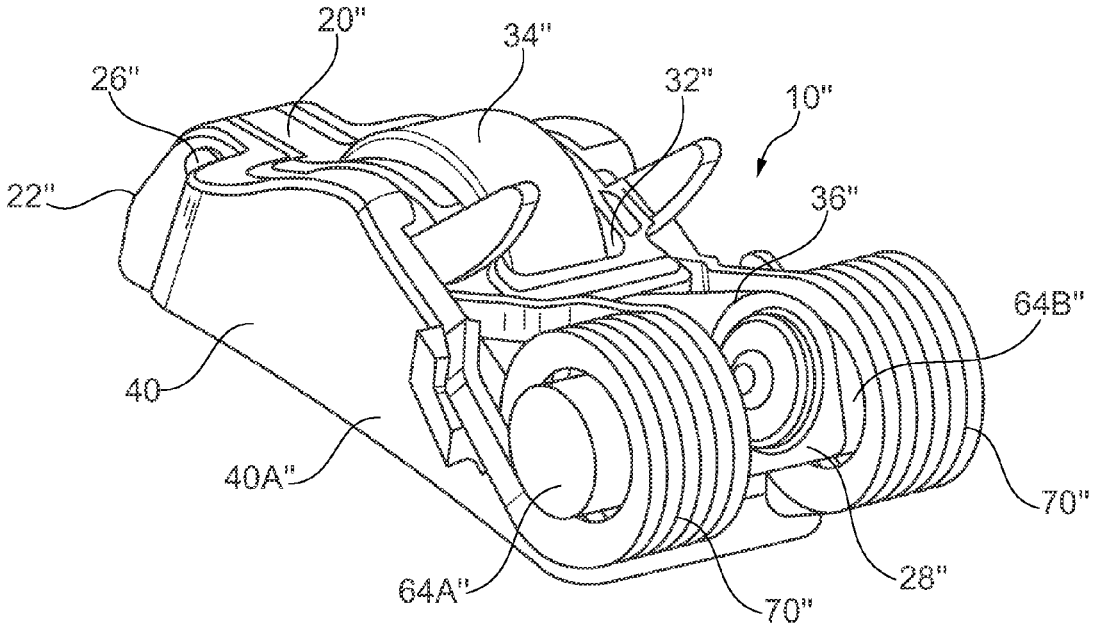
FIG. 6 is a perspective view of a switchable roller finger follower according to another embodiment of the invention in which the inner lever is the secondary lever.
Figure 7:
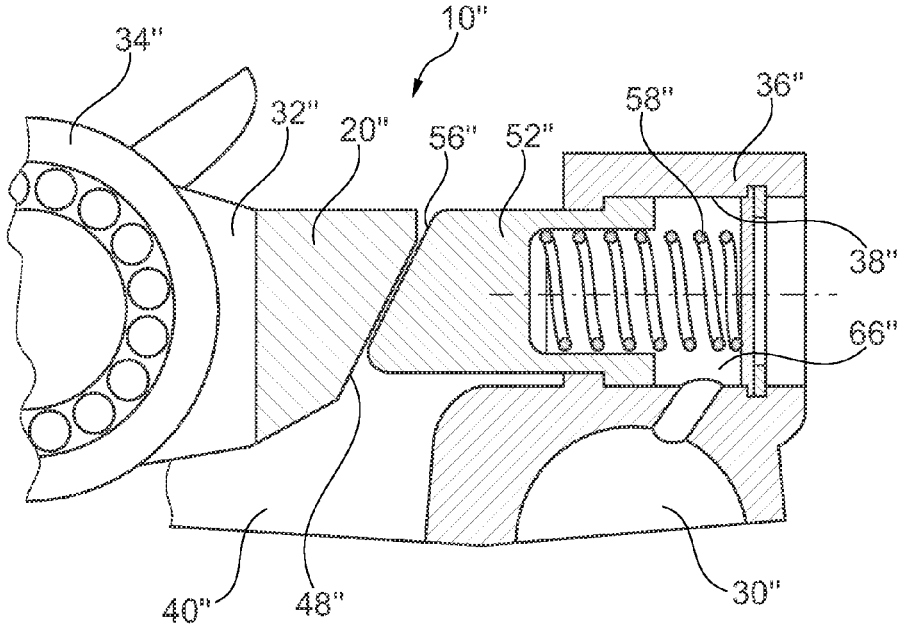
FIG. 7 is a partial cross-sectional view through the switchable roller finger follower shown in FIG. 6, showing the coupling pin in the first, locked position in which the inner lever is locked in a first lift position.

Referring to FIGS. 6 and 7, another embodiment of a switchable roller finger follower 10" is shown. The switchable roller finger follower 10" is for activation/deactivation of a gas exchange valve and in contrast to the embodiment of the switchable roller finger follower 10 shown in FIG. 1, the outer lever 40" is the primary lever, and includes outer arms 40A" and 40B". The coupling device 36" with the coupling pin 52" is located at the second end 28" of the finger follower 10" on the outer lever 40". The coupling pin 52" is biased by spring 58" toward the locked position, shown in FIG. 7. Semispherical cavity 30" for a support head is also located in the outer lever 40" and provides a passage for pressurized hydraulic fluid to be delivered to the pressure space 66". The spring posts 64A", 64B", which are optional, are also located at the second end of the outer lever 40". If provided, lost motion return springs 70" are located thereon and act on the inner lever 20" to bias it toward the active position. However, the spring posts 64A", 64B" and the return springs 70" could be omitted, similar to the second embodiment of the finger follower 10', and the strength of the spring 58" increased so that it functions to absorb the lost motion and lash adjustment. The coupling pin 52" includes ramp surface 56". The inner lever 20" is the secondary lever, and preferably includes a slot 32" for a cam roller 34" mounted therein that acts as the cam contact surface. The inner lever 20" is connected at the first end 22" to the outer lever 40" by an axle 26". The opposite end of the inner lever 20" includes a ramp 48" complementary to the ramp surface 56" on the coupling pin 52".

In this arrangement the operation of the switchable roller finger follower 10" is the similar to the switchable roller finger follower 10 with the exception that in the lost motion position the associated valve is deactivated, as the cam on the camshaft presses the inner lever 20" downwardly and the lost motion is absorbed by pressing the coupling pin 52" inwardly into the coupling pin bore 38", with the springs 70", if present, also acting to absorb the lost motion along with the spring 58", resulting in no lift being transferred to the outer, primary lever 40". For the finger follower 10" in the first locking position, where the associated gas exchange valve is active, pressurized hydraulic fluid applied to the pressure space 66" holds the coupling pin 52" in the position shown in FIG. 7 to provide lift to the associated valve stem.

As noted above, a wear resistant coating can be applied to one or more of the contact surfaces. Additionally, hydraulic pressure could be used for deactivation of the coupling mechanism instead of activation.

While the preferred embodiment of the invention has been described in detail, those skilled in the art will recognize that other changes could be made to a switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

What is claimed is:

1. A switchable roller finger follower having at least two lift modes for a valve train of an internal combustion engine, comprising:

an primary lever having first and second ends, with a valve stem support located at the first end and a lash adjuster support recess located at the second end;

a secondary lever mounted for pivoting movement to the primary lever at the first end of the primary lever by a pivot axle, the secondary lever including a cam contact surface, and a coupling surface facing the second end; and a coupling device located on the primary lever that includes a coupling pin arranged to move in a longitudinal direction between at least a first locking position, in which the secondary lever is locked to the primary lever at least in an activation direction of a valve, and an unlocked position, in which the secondary lever pivotable relative to the primary lever, the coupling pin including a ramp surface that engages the coupling surface, and a locking arrangement for locking the coupling pin in the first locking position.

2. The switchable roller finger follower of claim 1, wherein the coupling surface of the secondary lever comprises a ramp that is complementary to the ramp surface.

3. The switchable roller finger follower of claim 2, wherein the coupling pin is biased toward the first locking position by a spring.

4. The switchable roller finger follower of claim 3, wherein a spring force of the spring is less than a force generated by a valve spring acted on by the finger follower so that the spring acts as a lost motion spring for the secondary lever, and the coupling pin is adapted to reciprocate for each rotation of a cam between the first locking position and the unlocked position.

5. The switchable roller finger follower of claim 3, wherein the coupling device comprises a coupling housing located on the primary lever with a coupling pin bore in which the coupling pin is located.

6. The switchable roller finger follower of claim 5, wherein a hydraulic fluid passage is located in the primary lever and extends to a pressure space in the coupling pin bore defined behind the coupling pin, and pressurized hydraulic fluid provided to the pressure space locks the coupling pin in the first locking position.

7. The switchable roller finger follower of claim 1, wherein the primary lever is an inner lever, and the secondary lever includes outer arms mounted for pivoting movement to the inner lever that extend along longitudinal sides of the inner lever, each of the outer arms of the secondary lever includes a coupling surface, a slot is located in the inner lever in which a roller is mounted by a transverse axle, and the coupling pin includes transversely extending arms that contact a respective one of the coupling surfaces of each of the outer arms, and a ramp surface is located on each of the transversely extending arms.

8. The switchable roller finger follower of claim 7, wherein the coupling surfaces of the outer arms comprise ramps that are complementary to the ramp surfaces of the transversely extending arms.

9. The switchable roller finger follower of claim 8, wherein the coupling pin is biased toward the outer arms by a spring.

10. The switchable roller finger follower of claim 9, wherein the ramps on the outer arms and the ramp surfaces of the transversely extending arms of the coupling pin remain in constant contact.

11. The switchable roller finger follower of claim 10, wherein the constant contact between the ramps on the outer arms and the ramp surfaces of the transversely extending arms of the coupling pin eliminates coupling pin lash.

12. The switchable roller finger follower of claim 9, further comprising separate lost motion springs located between the inner lever and the outer arms.

13. The switchable roller finger follower of claim 1, wherein at least one of (1) the coupling surface on the secondary lever, or (2) the ramp surface on the coupling pin are coated with a friction or wear reducing coating.

14. The switchable roller finger follower of claim 1, wherein the primary lever is an outer lever, and the secondary lever is an inner lever mounted for pivoting movement to the outer lever, and a slot is located in the inner lever in which a roller is mounted by a transverse axle.

15. The switchable roller finger follower of claim 14, wherein the coupling surface of the secondary lever comprises a ramp that is complementary to the ramp surface.

16. A switchable roller finger follower having at least two lift modes for a valve train of an internal combustion engine, comprising:

an inner lever having first and second ends, with a valve stem support located at the first end and a lash adjuster support recess located at the second end, and a slot in which a roller is mounted by a transverse axle;

two outer arms that extend along longitudinal sides of the inner lever are mounted for pivoting movement at the first end of the inner lever by a pivot axle, the outer arms each include a high lift cam contact surface located adjacent to the roller, and a coupling surface facing the second end; and a coupling device located on the inner lever that includes a coupling pin arranged to move in a longitudinal direction between at least a first locking position, in which the outer arms are in a first lift position and are lockable to the inner lever at least in an activation direction of a valve, and an unlocked position, in which the outer arms are pivotable relative to the inner lever, the coupling pin including transversely extending arms that contact the respective coupling surface of each of the outer arms, and a locking arrangement for locking the coupling pin in the first locking position.

17. The switchable roller finger follower of claim 16, wherein the coupling surfaces of the outer arms comprise ramps, and the transversely extending arms include complementary ramp surfaces to the ramps.

18. A valve train comprising:

a switchable roller finger follower having at least two lift modes for a valve train of an internal combustion engine, including a primary lever having first and second ends, with a valve stem support located at the first end and a lash adjuster support recess located at the second end, and a secondary lever mounted for pivoting movement at one end of the primary lever by a pivot axle, the secondary lever includes a cam contact surface, and a coupling surface facing the second end, and a coupling device located on the primary lever includes a coupling pin arranged to move in a longitudinal direction between at least a first locking position, in which the secondary lever is locked to the primary lever at least in an activation direction of a valve, and an unlocked position, in which the secondary lever is pivotable downwardly relative to the primary lever, the coupling pin including a ramp surface that engages the coupling surface; the coupling device comprises a coupling housing located on the primary lever with a coupling pin bore in which the coupling pin is located;

a hydraulic fluid passage located in the primary lever and that extends to a pressure space in the coupling pin bore defined behind the coupling pin, and pressurized hydraulic fluid provided to the pressure space locks the coupling pin in the first locking position; and a pressure regulator connected to the hydraulic fluid passage controls a flow of the hydraulic fluid to the pressure space for locking the coupling pin in the first locking position.

19. The valve train of claim 18, wherein the pressure regulator is a variable pressure regulator and regulates a pressure of the hydraulic fluid fed to the pressure space so that the coupling pin is lockable in at least a second locking position providing a different lift than the first locking position.

* * * * *